United States Patent [19]

Ketterer et al.

[11] 4,366,638

[45] Jan. 4, 1983

[54] BOX MAGAZINE FOR FIREARMS

[76] Inventors: Dieter Ketterer, Keplerstrasse 38; Horst Jakubaschk, Im Öschle 28, both of, 7238 Oberndorf; Erich Weisser, Eichbachstrasse 195, 7441 Tennenbronn, all of Fed. Rep. of Germany

[21] Appl. No.: 238,918

[22] Filed: Feb. 27, 1981

[30] Foreign Application Priority Data

Mar. 27, 1980 [DE] Fed. Rep. of Germany ..... 3011793

[51] Int. Cl.[3] ..... F41C 25/02

[52] U.S. Cl. ..... 42/50

[58] Field of Search ..... 42/50, 18, 22, 7

[56] References Cited

U.S. PATENT DOCUMENTS

| | | | |
|---|---|---|---|
| 2,777,235 | 1/1957 | Hopkins | 42/50 |
| 3,087,270 | 4/1963 | Stoner | 42/50 |
| 3,577,860 | 5/1971 | Jestrabek | 42/50 |
| 3,906,652 | 9/1975 | Evans | 42/50 |

FOREIGN PATENT DOCUMENTS

| | | | |
|---|---|---|---|
| 635534 | 11/1963 | France | 42/50 |
| 406904 | 8/1966 | Switzerland | 42/50 |
| 598560 | 4/1978 | Switzerland | 42/50 |

*Primary Examiner*—Charles T. Jordan
*Attorney, Agent, or Firm*—William D. Hall

[57] ABSTRACT

The present invention relates to a box magazine for firearms, having a longitudinal housing (1), one end thereof being provided with an ejection opening for the frontmost cartridge contained in the magazine; it includes a follower, spring loaded in the direction of this ejection opening and being in a contacting relationship with the last cartridge, and with the follower spring, designed as a scroll spring (13), whose one end is attached to the housing in the vicinity of the ejection opening and whose scroll spring shaft (11, 12) is mounted on the follower (4) and whose axis is arranged at right angles to the direction of motion of the follower. In order to design a magazine of this type in such a manner that the length of the stack of cartridges is only somewhat less than the overall length of the magazine and that the magazine is suitable for use with small arms having a high firing cadence, when rolled up the scroll spring (13) assumes generally the full cross-sectional area of the magazine, the axis of the scroll spring shaft (11, 12) is arranged at right angles to the longitudinal axis of the cartridges and a spiral spring (9), supporting the effect of the scroll spring (13), is housed within the scroll spring (FIG. 1).

8 Claims, 2 Drawing Figures

BOX MAGAZINE FOR FIREARMS

Figure 1:
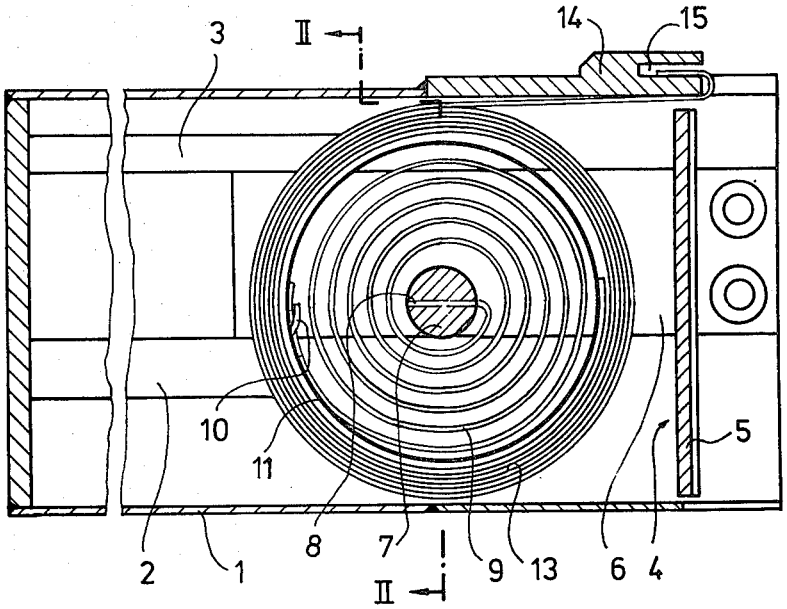

The present invention relates to a box magazine for firearms, having a longitudinal housing, one end thereof being provided with an ejection opening for the frontmost cartridge contained in the magazine, a follower spring loaded in the direction of the ejection opening and being in a contacting relationship with the last cartridge, and with a follower spring generating the spring force, designed as a scroll spring, whose open end is attached to the housing in the vicinity of the ejection opening and whose scroll spring shaft is mounted on the follower and whose axis is arranged at right angles to the direction of motion of the follower.

Magazines of this type are known (German Pat. No. 1,703,342, U.S. Pat. Nos. 3,087,270 and 2,777,235). These known magazines utilise the advantageous characteristic of scroll springs of having a very flat spring curve, i.e. they provide a uniform force that is virtually independent of the spring travel. However this force is not very great, for which reason these scroll springs are only suitable for magazines having a limited capacity of 10 or 20 rounds, for example. However a scroll spring would be especially desirable, particularly for magazines having larger capacities, as it provides an especially favorable ratio between non-usable and usable magazine volume, i.e. the ratio of the longitudinal area of the magazine filled by the spring and follower to the length of the magazine housing the cartridges. Customary magazine springs of the type generally employed in actual practice are springs wound in the nature of helical springs, whose cross-sectional area however is not annular but rectangular, matched to the cross-sectional area of the magazine. However these helical springs require about one third of the length of the magazine and have a relatively steeply sloping spring curve. Scroll springs, on the contrary, have not been able to be employed in actual practice, as the forces generated by them are only sufficient for small magazine capacities and, with the high firing cadences possible today, the stack of cartridges cannot be advanced quickly enough when a burst is fired. The follower spring, namely, must advance the entire supply of cartridges by the thickness of one cartridge within a period in the order of 1/100 sec., requiring significant acceleration and force.

It is therefore the object of the present invention to design a box magazine having a large capacity of more than 20 rounds, if possible, in such a manner that the overall length of the magazine is only slightly greater than the length of the stack of cartridges and the magazine is suitable for modern small arms having high firing cadences.

According to the present invention, this object is solved in a magazine of the nature mentioned at the outset in that when rolled up, the scroll spring assumes generally the full cross-sectional area of the magazine, in that the axis of the scroll spring shaft is arranged at right angles to the longitudinal axis of the cartridges, and in that a spiral spring, supporting the effect of the scroll spring, is housed within the scroll spring.

As a result of the combination of these characteristics, the object of the invention is solved in a surprisingly practical manner, with a minimum of fabricational effort. Since the scroll spring fills nearly the entire clear cross-sectional area of the magazine, space utilisation is optimum and a maximum developable force is produced from this space by means of a scroll spring. Arrangement of the scroll spring shaft at right angles to the longitudinal axis of the cartridges permits a greater scroll spring diameter to be achieved which, with a given magazine length, always provides sufficient space for housing the spiral spring. While it is also known practice (U.S. Pat. No. 2,777,235) to align the axis of the scroll spring shaft at right angles to the longitudinal axis of the cartridges, only small portions of the space actually available are utilised in this case and the force developed is consequently relatively low, even though two scroll springs are employed. For this reason, the magazine illustrated therein is only designed for a capacity of 10 cartridges, i.e. is hardly suitable for automatic firearms.

While in all known magazines, the outer end of the scroll spring is attached in the area of the ejection opening, the inner end of the scroll spring is attached to a scroll spring shaft, about which the scroll spring winds up and down. In all known embodiments, the scroll spring shaft is designed as a pin; in a preferred embodiment of the present invention, however, the scroll spring shaft is designed as a cylindrical housing. In this embodiment, the outside diameter of the scroll spring shaft is smaller than the corresponding clear width of the magazine by only about twice the winding thickness of the scroll spring. This means that the scroll spring can be wound up on the scroll spring shaft with only relatively few turns, i.e. that the scroll spring shaft need only be slightly smaller than the corresponding clear width of the magazine. This results in a favorable design, as the curvature radius of the scroll spring need not be very small, on the one hand, and the end of the scroll spring acts on relatively long leverage, on the other.

Scroll spring shaft and spiral spring can be arranged axially one next to the other, as the scroll spring shaft is preferably overmounted, i.e. mounted only on one side. According to an embodiment of the present invention, however, especially good space utilisation results when the spiral spring is housed in the scroll spring shaft. A condition herefor is that the scroll spring shaft be designed as a cylindrical housing, i.e. as a hollow body. This permits the width of both the scroll spring and the spiral spring to be generally equal to the clear width of the magazine, i.e. generally equal to the diameter or the corresponding width of the cartridges. In this embodiment, one end of the spiral spring is preferably attached to a housing serving as a scroll spring shaft, with the other end being attached to a pin fixedly attached to the follower. Thus, this pin transmits the feed force to the follower, on the one hand, while simultaneously serving as a fixed rotational point for the winding and unwinding motion of the spiral spring, on the other.

Preferably, the follower has a lateral extension, extending in the longitudinal direction of the magazine, to which the pin is attached and which is guided in a longitudinal bead of the magazine. Longitudinal beads of this nature are required anyway for reinforcing the relatively thin-walled magazine housing and are also employed for housing the follower extension.

In order to keep the space requirement for the spring arrangement in the direction of the follower motion as small as possible, in a preferred embodiment of the present invention the clearance between the pin and an end plate of the follower, against which the last cartridge is in a contacting relationship, is only slightly greater than one half of the outside diameter of the scroll spring in the wound-up state. As tested and proven in a practical example of the present invention, this permits the space requirement for the follower spring to be reduced to approximately 8% of the length of the magazine. The advantages of the present invention are particularly noticeable if the magazine has a capacity of far more than 20 rounds, for example, a capacity of 50 rounds, and if the magazine is intended for firing caseless ammunition. In spite of the high firing cadences able to be achieved by a known modern weapon for caseless ammunition, in which the period of time during which the stack of cartridges in the magazine can be advanced amounts to only approximately 1/100 sec., a dependable magazine having a capacity of 50 rounds can be achieved. In this case, the magazine has a length of only less than 0.5 m and can be comfortably located parallel to the barrel of the weapon. This positioning attitude is especially favorable as the longitudinal direction of the cartridges in the magazine can then be arranged generally radial to the axis of the barrel, as a swivel breech is employed in a known weapon of this type; this swivel breech accepts the cartridge in this attitude and then swivels it only 90° for firing. Thus, the advantages of the present invention can be seen especially clearly in conjunction with the employment of caseless ammunition and this known weapon.

Figure 2:
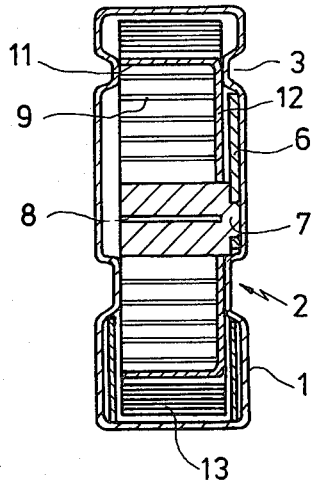

The above discussed and other objects, features, advantages and embodiments of the present invention will become more apparent from the following description thereof, when taken in connection with the practical examples shown in the accompanying drawings, showing a simplified, schematic representation, with details which are not of significance or necessary for understanding the invention having been omitted. In the drawings, FIG. 1 shows a longitudinal section taken through a magazine having a scroll spring and a spiral spring; and FIG. 2 shows a section taken along line II—II in FIG. 1.

Referring now to the drawings, wherein like reference numerals designate like parts throughout the several views, the box magazine shown therein comprises a longitudinal housing 1, fabricated of sheet metal and provided with longitudinal beads 2 and 3 for reinforcement. The unillustrated cartridges are housed in the magazine, which is shown in the empty state, in the form of a stack, with the longitudinal axis of the cartridges being aligned at right angles to the longitudinal axis of the magazine, in the customary manner, with the longitudinal axis of the cartridges extending parallel to the plane of the drawing in FIG. 1. Housed in a longitudinally slidable manner in the magazine is a follower 4, comprising a follower plate 5, whose contours are generally matched to the clear cross-sectional area of the magazine, with one longitudinal side of an (unillustrated) cartridge (or one convex surface line in the case of cylindrical cartridges) being in a contacting relationship thereagainst. Located directly adjacent to follower plate 5 on one side thereof is a one-piece extension 6, extending in the space between the two longitudinal beads 2 and 3 and being guided thereby. Attached, for example welded, to extension 6 is a pin 7, whose axis extends perpendicular to the plane of extension 6 (i.e. perpendicular to the longitudinal axis of the cartridges and perpendicular to the longitudinal axis of the magazine). Machined into pin 7 is a cross slot 8, holding the end of a spiral spring 9, designed as a flat spring whose width is somewhat narrower than the clear width of the magazine. The other, outer end of the spiral spring engages an inwardly bent tab 10 of a cylinder jacket 11, which forms a housing for spiral spring 9 and displays an enclosing annular plate 12 on one side, by means of which it is mounted on pin 7.

Cylinder jacket 11 and plate 12 not only form a housing for spiral spring 9, but also serve as a scroll spring shaft for a scroll spring 13, whose inner end is attached to the outside of cylinder jacket 11. With the magazine in the empty state, scroll spring 13 is wound about cylinder jacket 11, with its end being inserted in a slot 15 machined into an extension member 14 which is attached to the magazine housing. With scroll spring 13 wound up, the height of follower spring 9, 13 is generally equal to the clear height of the magazine, as can be seen in the section shown in FIG. 1. The width of scroll spring 13, which is also designed as a flat spring, is generally equal to the clear width of the magazine between opposite beads 3 and 2.

When the magazine is filled with cartridges, with the longitudinal sides thereof being in a contacting relationship one with the other, the longitudinal side of the first cartridge to be inserted, i.e. the last cartridge to be used, is in a contacting relationship with follower plate 5 when it is slid in, causing scroll spring 13 to be wound up and tensioned and spiral spring 9 to be torsioned and tensioned. At the same time, scroll spring shaft 11, 12, forming a housing for sprial spring 9, rotates about its cylindrical axis, which shifts parallel to itself, together with follower 4, in the longitudinal direction of the magazine. After 50 cartridges have been inserted, the magazine is full, with the major portion of scroll spring 13 extending along the upper narrow side shown in FIG. 1 of the magazine housing. If, when the weapon is loaded, a cartridge is inserted into the chamber of the unillustrated weapon by means of a cocking lever, in the longitudinal direction of the cartridge, i.e. in the direction from extension member 14 to the opposite, bottom narrow side of the magazine in FIG. 1, follower spring 9, 13 then advances the stack of cartridge by an amount equal to the width of one cartridge, until, after the last cartridge has been removed from the magazine, the position shown in the drawing is again reached, in which the springs are relieved.

In a working model, the scroll spring generated approximately $\frac{3}{4}$ and the spiral spring approximately $\frac{1}{4}$ of the follower force. In the working model, the magazine was designed for 50 rounds of caseless ammunition and for employment in a weapon having a swivel breech, of the type known from German Disclosed Patent Application No. 2,813,633 and German Disclosed Patent Application No. 2,630,659.

Obviously, many modifications and variations of the present invention are possible in the light of the above teachings. It should therefore be understood that within the scope of the appended claims, the invention may be practised otherwise than as specifically described. In particular, individual characteristics of the invention can be employed individually or in combination one with the other.

Reference should also be made to the fact that the unillustrated one-way lock in the magazine is located to the right of the area in which follower plate 5 is shown in FIG. 1.

We claim:

1. A box magazine for firearms, having a longitudinal housing, one end thereof being provided with an ejection opening for the frontmost cartridge contained in the magazine, a follower spring loaded in the direction of the ejection opening and being in a contacting relationship with the last cartridges, and with a follower spring generating the spring force, designed as a scroll spring, whose open end is attached to the housing in the vicinity of the ejection opening and whose scroll spring shaft is mounted on the follower and whose axis is arranged at right angles to the direction of motion of the follower, in which when rolled up, the scroll spring assumes generally the full cross-sectional area of the magazine, in which the axis of the scroll spring shaft is arranged at right angles to the longitudinal axis of the cartridges, and in which a spiral spring, supporting the effect of the scroll spring, is housed within the scroll spring.

2. The magazine set forth in claim 1, in which the scroll spring shaft, to which the inner end of the scroll spring is attached, is designed as a cylindrical housing.

3. The magazine set forth in claim 1, in which the outside diameter of the scroll spring shaft is smaller than the corresponding clear height (cartridge length) of the magazine by an amount equal to approximately twice the winding thickness of the scroll spring.

4. The magazine set forth in claim 2, in which the spiral spring is housed in the scroll spring shaft.

5. The magazine set forth in claim 4, in which one end of the spiral spring is attached to the shaft, with the other end being attached to a pin which is fixedly attached to the follower.

6. The magazine set forth in claim 5, in which the follower displays a lateral extension, extending in the longitudinal direction of the magazine, to which the pin is attached and which is guided between two longitudinal beads of the magazine.

7. The magazine set forth in claim 5, in which the clearance between the pin and an end plate of the follower, against which the last cartridge is in a contacting relationship, is only slightly greater than one half of the outside diameter of the scroll spring when wound up.

8. The magazine set forth in claim 1, in which the spiral spring generates approximately $\frac{1}{4}$ of the follower force.

* * * * *